US007522173B1

(12) United States Patent
Berendsen

(10) Patent No.: US 7,522,173 B1
(45) Date of Patent: Apr. 21, 2009

(54) CONVERSION OF DATA IN AN SRGB FORMAT TO A COMPACT FLOATING POINT FORMAT

(75) Inventor: John W. Berendsen, Beaconsfield (CA)

(73) Assignee: NVIDIA Corporation, Santa Clara, CA (US)

( * ) Notice: Subject to any disclaimer, the term of this patent is extended or adjusted under 35 U.S.C. 154(b) by 513 days.

(21) Appl. No.: 11/360,362

(22) Filed: Feb. 23, 2006

(51) Int. Cl.
*G09G 5/02* (2006.01)
*G09G 5/00* (2006.01)

(52) U.S. Cl. ..... 345/604; 345/600; 345/603; 345/610

(58) Field of Classification Search ..... 345/603, 345/604, 610, 600
See application file for complete search history.

(56) References Cited

U.S. PATENT DOCUMENTS

| | | | | | |
|---|---|---|---|---|---|
| 4,987,485 | A * | 1/1991 | Hirota | 358/516 |
| 4,989,091 | A | 1/1991 | Lucas | |
| 5,012,163 | A | 4/1991 | Alcorn et al. | |
| 5,061,927 | A * | 10/1991 | Linnenbrink et al. | 341/138 |
| 5,519,823 | A | 5/1996 | Barkans | |
| 5,990,894 | A * | 11/1999 | Hu et al. | 345/418 |
| 6,043,804 | A * | 3/2000 | Greene | 345/601 |
| 6,061,707 | A * | 5/2000 | Dibrino et al. | 708/505 |
| 6,104,415 | A | 8/2000 | Gossett | |
| 6,246,396 | B1 * | 6/2001 | Gibson et al. | 345/604 |
| 6,593,925 | B1 | 7/2003 | Hakura et al. | |
| 6,738,526 | B1 | 5/2004 | Betrisey et al. | |
| 6,760,036 | B2 * | 7/2004 | Tidwell | 345/600 |
| 7,394,469 | B1 * | 7/2008 | Liu et al. | 345/594 |
| 2003/0058247 | A1 | 3/2003 | Naegle | |
| 2003/0142101 | A1 | 7/2003 | Lavelle et al. | |
| 2004/0036898 | A1 * | 2/2004 | Takahashi | 358/1.9 |
| 2004/0066386 | A1 | 4/2004 | Leprevost | |
| 2004/0100466 | A1 * | 5/2004 | Deering | 345/428 |
| 2004/0104917 | A1 | 6/2004 | Platt et al. | |
| 2005/0024382 | A1 * | 2/2005 | Ho et al. | 345/601 |
| 2005/0063586 | A1 * | 3/2005 | Munsil et al. | 382/162 |
| 2005/0128499 | A1 * | 6/2005 | Glickman | 358/1.9 |

OTHER PUBLICATIONS

"Lookup Table". Wikimedia Foundation. Sep. 21, 2004. http://www.fact-index.com/l/lo/lookup_table.html.
"Gamma Correction Explained". CGSD Corporation. Jul. 4, 1997. http://www.cgsd.com/papers/gamma_intro.html.
Hammersley, T. "Bilinear Interpolation of Texture Maps". Oct. 19, 1999. http://www.gamedev.net/reference/articles/article810.asp.

* cited by examiner

*Primary Examiner*—Xiao M Wu
*Assistant Examiner*—David T Welch
(74) *Attorney, Agent, or Firm*—Patterson & Sheridan, LLP

(57) ABSTRACT

Systems and methods for processing linear colorspace data may be reused to process nonlinear colorspace data at a comparable performance level while maintaining the precision of the nonlinear colorspace data. Nonlinear colorspace data is converted to a compact floating point format in a linear colorspace used by conventional graphics processors. The compact floating point format includes an 8 bit explicit mantissa (without an implied leading one) and a 3 bit exponent to maintain the precision of the nonlinear colorspace data. The 8 bit mantissa may be processed by conventional texture filtering units designed to process 8 bit (fixed or floating point) color values. The 3 bit exponent may by processed by conventional texture filtering units designed to process floating point color values.

15 Claims, 5 Drawing Sheets

CONVERSION OF DATA IN AN SRGB FORMAT TO A COMPACT FLOATING POINT FORMAT

BACKGROUND OF THE INVENTION

1. Field of the Invention

Embodiments of the present invention generally relate to converting data represented in a nonlinear colorspace into a linear floating point format and, more specifically, to converting sRGB colorspace data into a linear floating point format.

2. Description of the Related Art

Nonlinear colorspaces, such as sRGB may be used to efficiently represent colors and to ease the exchange of color data between different color devices, e.g., display or print devices. Image color data used as texture maps for graphics processing may be represented in a nonlinear colorspace. Rather than convert the nonlinear colorspace texture map, a graphics processor may process the texture map as if it were represented in a linear colorspace. The resulting output image may include visual artifacts that would not be present if the texture map were converted to a native (linear) colorspace prior to being processed by the graphics processor.

Accordingly, there is a desire to process texture maps stored in a nonlinear colorspace while reusing existing texture filtering units in a graphics processor that are designed to process linear colorspace texture data.

SUMMARY OF THE INVENTION

The current invention involves new systems and methods for reusing texture filtering units designed to process linear colorspace data to process nonlinear colorspace data while maintaining the precision of the nonlinear colorspace data and the performance of the texture filtering units. Nonlinear colorspace data is converted to a compact floating point format in a linear colorspace used by conventional graphics processors. The compact floating point format includes an 8 bit explicit mantissa (without an implied leading one) and a 3 bit exponent to maintain the precision of the nonlinear colorspace data. The 8 bit mantissa may be processed by conventional texture filtering units designed to process 8 bit (fixed or floating point) color values. The 3 bit exponent may by processed by conventional texture filtering units designed to process floating point color values. The processing throughput for nonlinear colorspace data is equivalent to the processing for 8 bit color values and is twice the processing throughput as 16 bit floating point color values.

Various embodiments of a method of the invention for converting nonlinear colorspace data to a linear colorspace represented in a compact floating point format include reading the nonlinear colorspace data from memory using texture map coordinates of a fragment, converting each component of the nonlinear colorspace data to produce linear colorspace components represented in the compact floating point format, and processing the linear colorspace components represented in the compact floating point format to produce filtered color components represented in a floating point format of the fragment.

Various embodiments of the invention include a system for converting nonlinear colorspace data to a linear colorspace represented in a compact floating point format. The system includes an explicit mantissa computation unit, an exponent computation unit, and a texture unit. The explicit mantissa computation unit is configured to convert a nonlinear colorspace component into an 8 bit mantissa of the compact floating point format in the linear colorspace. The exponent computation unit is configured to convert the nonlinear colorspace component into a 3 bit exponent of the compact floating point format in the linear colorspace. The texture unit is configured to compute a filtered texture component by processing converted nonlinear colorspace data represented in the compact floating point format to produce filtered color components represented in a floating point format.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous specific details are set forth to provide a more thorough understanding of the present invention. However, it will be apparent to one of skill in the art that the present invention may be practiced without one or more of these specific details. In other instances, well-known features have not been described in order to avoid obscuring the present invention.

Texture filtering units designed to process linear colorspace data may be used to process nonlinear colorspace data that is converted to a linear colorspace used by conventional graphics processors. The converted data is represented in a compact floating point format that uses less than 16 bits per texel. The compact floating point format maintains the precision of the nonlinear colorspace data to produce results that comply with the Microsoft's DirectX10 precision requirement for processing texture data in the sRGB (nonlinear colorspace) format. Furthermore, the compact floating point format may be processed using conventional texture filtering computation units designed for processing 8 bit fixed point color components and conventional texture filtering computation units designed for processing exponents of 16 bit floating point color components. Therefore, the performance of processing sRGB colorspace data is equal to the performance of processing 8 bit fixed point format data. In contrast, when the sRGB colorspace data is converted to a conventional 16 bit floating point format, the performance would be half the performance of processing 8 bit fixed point format data.

Figure 1A:
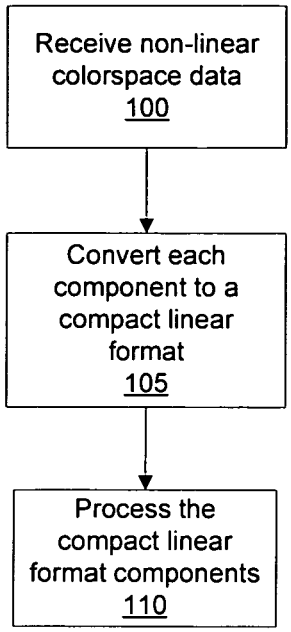
FIG. 1A illustrates a flow diagram of an exemplary method of converting nonlinear colorspace data to a compact linear colorspace format in accordance with one or more aspects of the present invention.

FIG. 1A illustrates a flow diagram of an exemplary method of converting nonlinear colorspace data to a compact linear colorspace format in accordance with one or more aspects of the present invention. In step 100 the nonlinear colorspace data is received. The nonlinear colorspace data may be read from a texture map and used to shade pixels during graphics processing. An example of a nonlinear colorspace is the sRGB colorspace that includes a greater number of samples in the lower range of the colorspace. sRGB colorspace components are typically represented using 8 or 10 bits per component. In step 105 each component of the nonlinear colorspace data is converted into a compact linear format. For example, the red, green, and blue components of sRGB colorspace data may each be converted into red, green, and blue components of linear RGB colorspace data. In step 110 the converted data represented in the compact linear format is processed.

Figure 1B:
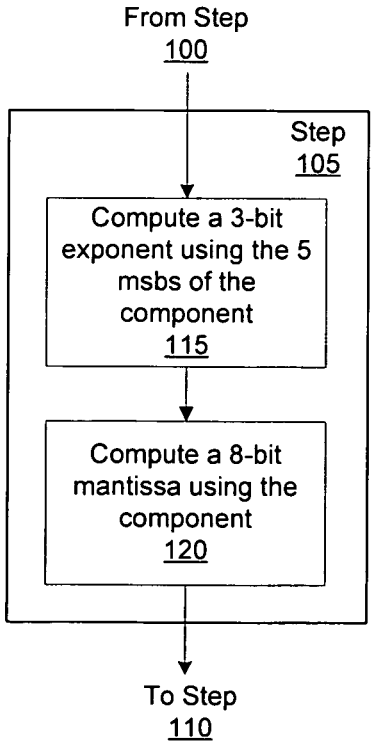
FIG. 1B illustrates an exemplary method of performing a step of the flow diagram shown in FIG. 1A in accordance with one or more aspects of the present invention.

FIG. 1B illustrates an exemplary method of performing step 105 of the flow diagram shown in FIG. 1A in accordance with one or more aspects of the present invention. In order to maintain the precision of the components in the lower range of the nonlinear colorspace, the components are converted into the floating point format. In step 115 a 3 bit exponent is computed using 5 most significant bits (msbs) of a nonlinear colorspace component. Using a subset of the bits in the nonlinear colorspace component to compute the exponent constrains the exponent to transition from one value to another at specific intervals. In other embodiments of the present invention more than 5 msbs or fewer than 5 msbs may be used to determine the exponent. The 3 bit exponent may by processed by conventional texture filtering units designed to process floating point color values.

In step 120 an 8 bit explicit mantissa is computed using the nonlinear colorspace component. Unlike a conventional floating point data format, the mantissa of the compact floating point format does not have an implied leading one. Because the exponent is constrained to change at particular boundaries, the explicit mantissa values may be modified, i.e. adjusted to be smaller or larger, to provide a more accurate conversion. The 8 bit mantissa may be processed by conventional texture filtering units designed to process 8 bit (fixed or floating point) color values. The processing throughput for nonlinear colorspace data may be equivalent to the processing throughput for 8 bit color values and twice the processing throughput of 16 bit floating point color values. Therefore, it is advantageous to use the compact floating point format rather than a conventional 16 bit per component floating point format.

Figure 2A:
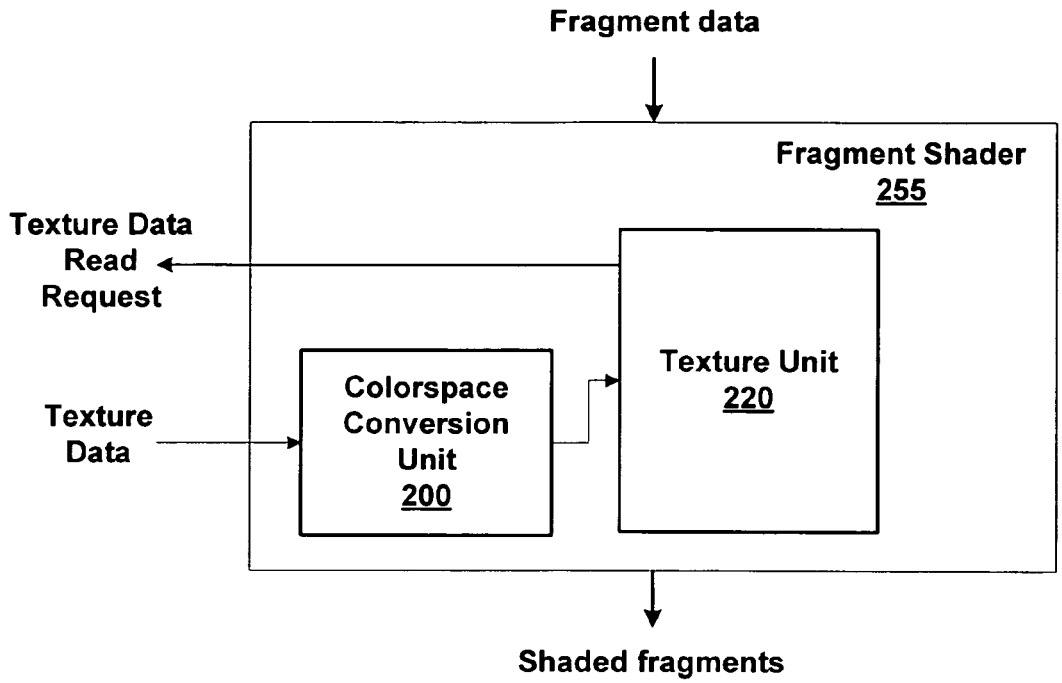
FIG. 2A is a block diagram of a portion of a graphics processor including a colorspace conversion unit in accordance with one or more aspects of the present invention.

FIG. 2A is a block diagram of a portion of a graphics processor, specifically a fragment processing unit, fragment shader 255 that includes a colorspace conversion unit 200, in accordance with one or more aspects of the present invention. In other embodiments of the present invention, colorspace conversion unit 200 may be included within another processor that also processes color data. Fragment shader 255 receives fragment data, including parameters associated with fragments (texture identifiers, texture coordinates, and the like). The texture identifiers may specify the texture map colorspace and format that the texture data is represented in, e.g., floating point, fixed point, bits per texel, and the like. A texture unit 220 generates read requests for texture data that may be stored as nonlinear colorspace data. Colorspace conversion unit 200 receives the nonlinear colorspace texture data and converts it to produce converted texture data represented in the compact floating point format including one or more components. Texture unit 220 receives the converted texture data directly from colorspace conversion unit 200 and filters the texture data using techniques known to those skilled in the art to produce filtered texture data.

In some embodiments of the present invention, fragment shader 255 may include one or more cache memories configured to store texture data. A first cache memory may store nonlinear colorspace texture data and a second cache memory may store converted texture data. Other processing units (not shown) may process the filtered texture data using techniques known to those skilled in the art to produce shaded fragments.

Figure 2B:
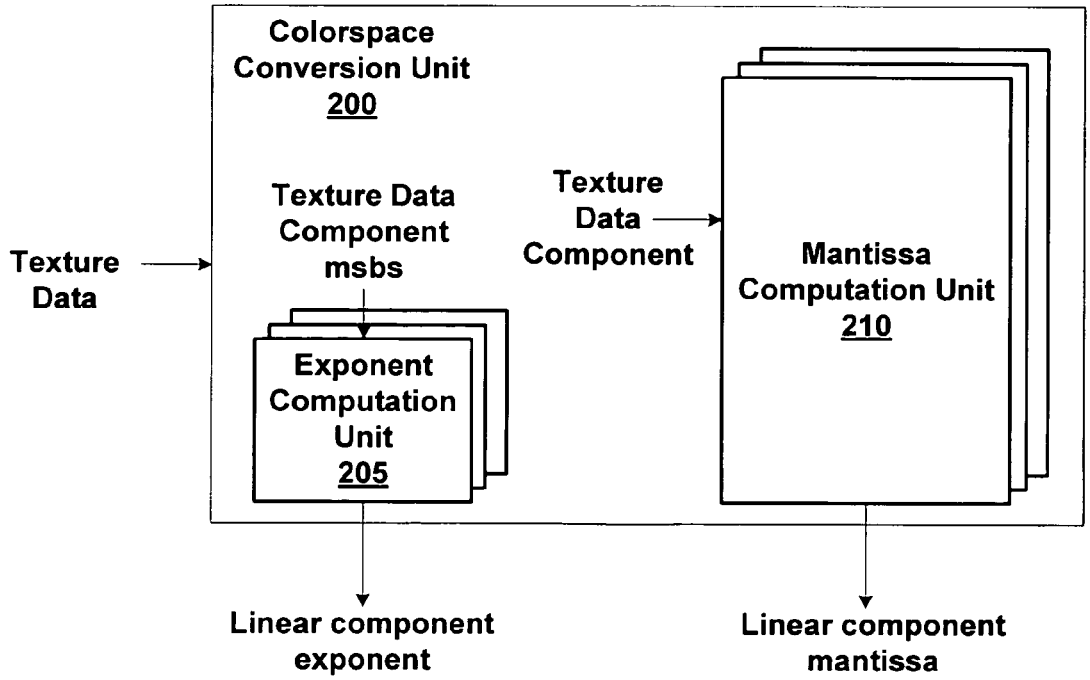
FIG. 2B is a block diagram of the colorspace conversion unit of FIG. 2A in accordance with one or more aspects of the present invention.

FIG. 2B is a block diagram of colorspace conversion unit 200 of FIG. 2A in accordance with one or more aspects of the present invention. Colorspace conversion unit 200 includes one or more mantissa computation units 210 and one or more exponent computation units 205. Each mantissa computation unit 210 receives a nonlinear colorspace component and converts the component into a linear space component explicit mantissa. Mantissa computation unit 210 may be a lookup table that includes an entry for each possible value of the nonlinear colorspace component. For example, when the nonlinear colorspace component is represented by 8 bits, the lookup table includes 256 entries and when the nonlinear colorspace component is represented by 10 bits, the lookup table includes 1024 entries. In other embodiments of the present invention, mantissa computation unit 210 may include one or more sub-units configured to evaluate a function that performs the conversion from the nonlinear colorspace to the linear colorspace.

Each exponent computation unit 205 receives at least a portion of a nonlinear colorspace component and converts the component into a linear space component exponent. Like mantissa computation unit 210, exponent computation unit 205 may also be a lookup table that includes an entry for each possible value of the nonlinear colorspace component. However, it is possible to reduce the size of the exponent lookup table while maintaining the precision needed to represent the nonlinear colorspace in the converted components. For example, the 5 msbs of the nonlinear colorspace component may be used to read a 3 bit exponent from one of 32 entries in the exponent lookup table. In other embodiments of the present invention, exponent computation unit 205 may include one or more sub-units configured to evaluate a function that performs the conversion from the nonlinear colorspace to the linear colorspace.

A color component represented in the compact floating point format has a value of $\text{mantissa}/128*2^{(exponent-7)}$. The largest number that may be represented is $255/128*2^0=1.992$ and the smallest increment is $2^{-7}*2^{-7}=2^{-14}=1/16768$. For the 8 bit per component format of sRGB data, the smallest slope is 1/12.92, corresponding to a smallest increment of $1/255*1/12.92=1/3294.6$ which is approximately $2^{-12}$. Therefore, the compact floating point format may be used to represent the precision required by the sRGB nonlinear colorspace data.

Figure 2C:
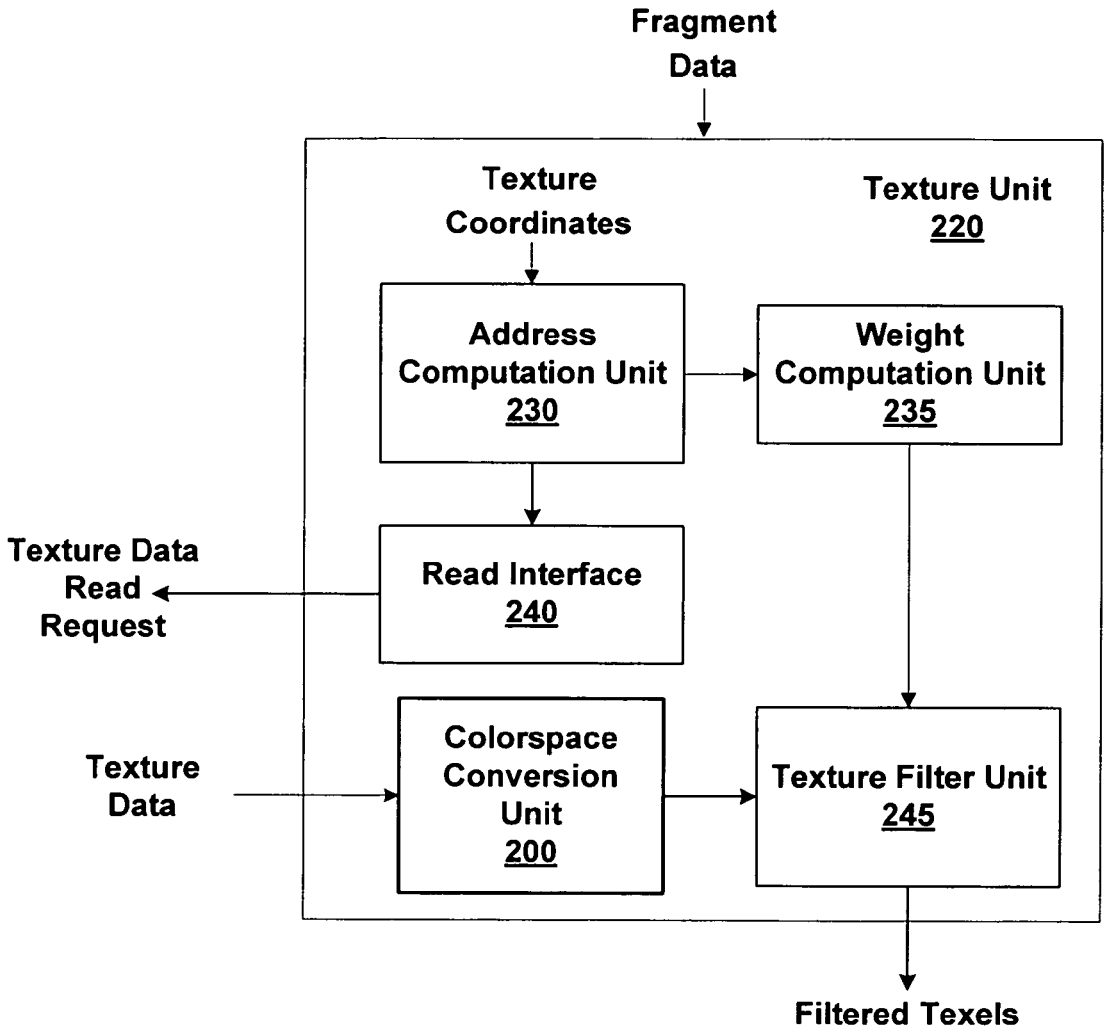
FIG. 2C is a block diagram of the texture unit of FIG. 2A in accordance with one or more aspects of the present invention.

FIG. 2C is a block diagram of texture unit 220 of FIG. 2A in accordance with one or more aspects of the present invention. In some embodiments, texture unit 220 receives fragment data from a rasterizer, e.g., program instructions, and parameters associated with fragments, e.g., texture identifiers, texture coordinates, and the like. A fragment is formed by the intersection of a pixel and a primitive. Primitives include geometry, such as points, lines, triangles, quadrilaterals, meshes, surfaces, and the like. A fragment may cover a pixel or a portion of a pixel. Likewise, a pixel may include one or more fragments and each fragment may correspond to one or more sets of texture coordinates.

Texture unit 220 may include computation units (not shown) configured to determine level of detail texture map values for a mip mapped texture map and unnormalized texture map coordinates using techniques known to those skilled in the art. An address computation unit 230 receives texture coordinates and computes an address corresponding to one or more texels. Address computation unit 230 outputs the computed address to a read interface 240. Read interface 240 outputs a texture data read request including the computed address to a memory, e.g., cache, RAM, ROM, or the like. In some embodiments of the present invention, read interface 240 may include a texel cache memory that is configured to store texels.

Address computation unit 230 outputs the fractional portions of the texture coordinates and the fractional portion of the texture map level of detail to weight computation unit 235. In some embodiments of the present invention, particularly those that support conventional bilinear or trilinear interpolation to produce filtered texture data, weight computation unit 235 computes bilinear weights using the fractional portions of the texture map coordinates and computes trilinear weights using the fractional portion of the texture map level of detail. The bilinear and trilinear weights are output to texture filter unit 245. In other embodiments of the present invention, weight computation unit 235 may also compute anisotropic weights that are output to texture filter unit 245.

Texture data read from memory are received from the memory by colorspace conversion unit 200. As previously described, colorspace conversion unit 200 converts the nonlinear colorspace components of the texture data into a linear space components in the compact floating point format. Linear colorspace texture data received by colorspace conversion unit 200 may be passed through colorspace conversion unit 200 unchanged to texture filter unit 245. Texture filter unit 245 receives the weights from weight computation unit 235 and the linear colorspace texture data from colorspace conversion unit 200. Texture filter unit 245 scales the converted texture data using the weights to produce scaled texture data, sums the scaled texture data to produce filtered texture data, and outputs the filtered texture data. The filtered texture data are output to a shader unit, described further herein, to compute a color for each fragment.

Figure 2D:
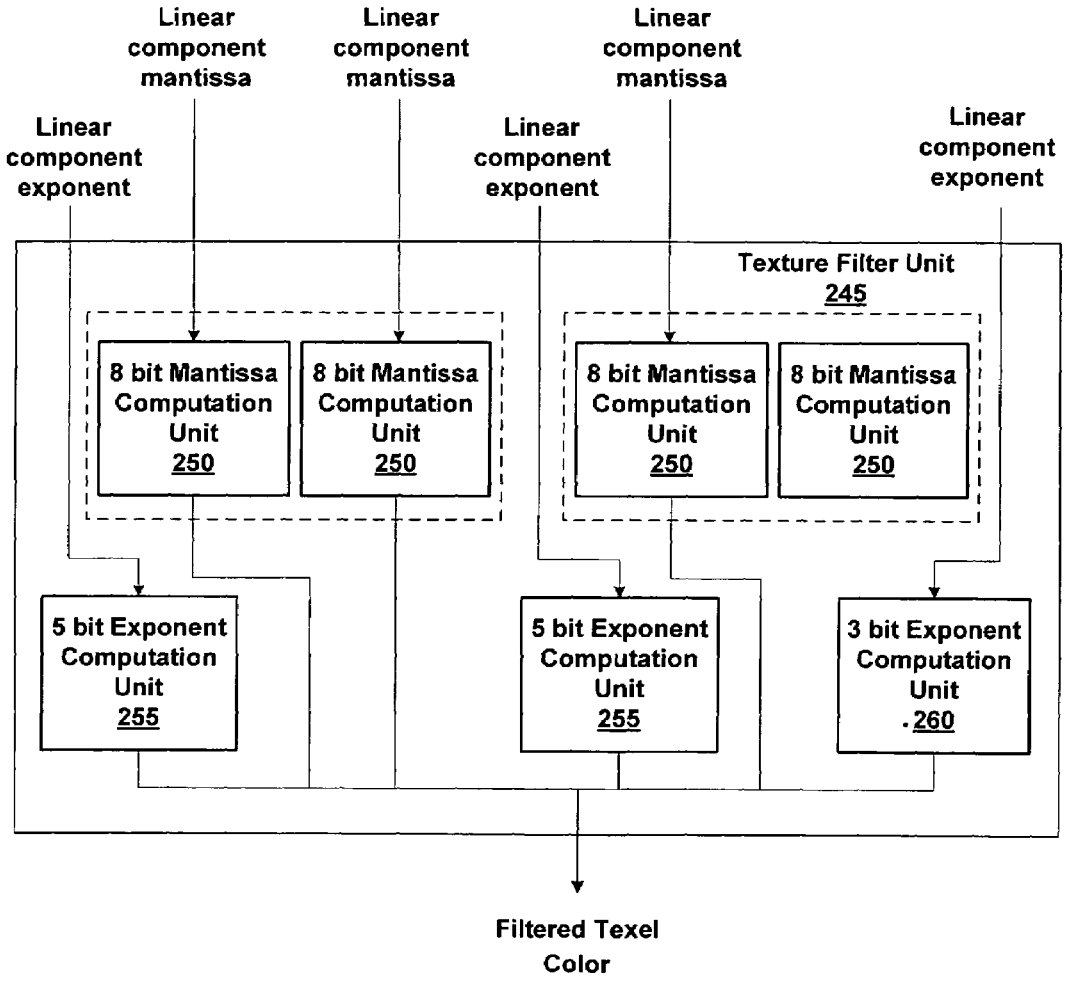
FIG. 2D is a block diagram of the texture filter unit of FIG. 2C in accordance with one or more aspects of the present invention.

FIG. 2D is a block diagram of the texture filter unit 245 of FIG. 2C, in accordance with one or more aspects of the present invention. Texture filter unit 245 is configured to process four 8 bit components in parallel, two 16 components in parallel, or one 32 bit component. Two 8 bit mantissa computation units 250 are linked together to process a 16 bit component and four 8 bit mantissa computation units 250 are linked together to process a 32 bit component. Texture filter unit 245 includes two 5 bit exponent computation units 255 that are configured to process two floating point format components in parallel. In order to process three converted mantissas and exponents in parallel to match the throughput performance of processing 8 bit components, an additional exponent computation unit, 3 bit exponent computation unit 260 is included in texture filter unit 245.

Converted mantissas and exponents received by texture filter unit 245 from color conversion unit 200 are input to 8 bit mantissa computation units 250, 5 bit exponent computation units 255 and 3 bit exponent computation unit 260 to produce 16 bit floating point format filtered color components. In particular, 8 bit mantissa computation units 250 may be used to process mantissas in the compact floating point format without modification. In other embodiments of the present invention, 7 bit mantissa processing units are used to process the linear component mantissas since 7 bits are adequate to maintain the precision of the converted components and produce a correctly filtered color component. 5 bit exponent computation units 255 may be used to process exponents in the compact floating point format without modification. Zeros are appended to the msbs of the 3 bit compact floating point format exponents for processing by 5 bit exponent computation units 255. 3 bit exponent computation unit 260 is dedicated to processing the compact floating point format exponent for one of the three color components (red, green, or blue). Therefore, the processing throughput for the converted components is equal to the processing throughput of 8 bit per component linear color data. If the nonlinear color components were simply converted to a 16 bit per component format, the processing throughput for converted components would be half the processing throughput achieved when the compact floating point format is used to represent the converted components.

The compact floating point format permits the reuse of existing computation units and while maintaining the processing throughput equal to that of 8 bit color data. The dedicated processing units that are needed to convert from the nonlinear colorspace to the linear colorspace and process the exponent, i.e., colorsapce conversion unit 200 and 3 bit exponent computation unit 260, require less die area than using dedicated processing units for the conversion and filtering.

Figure 3:
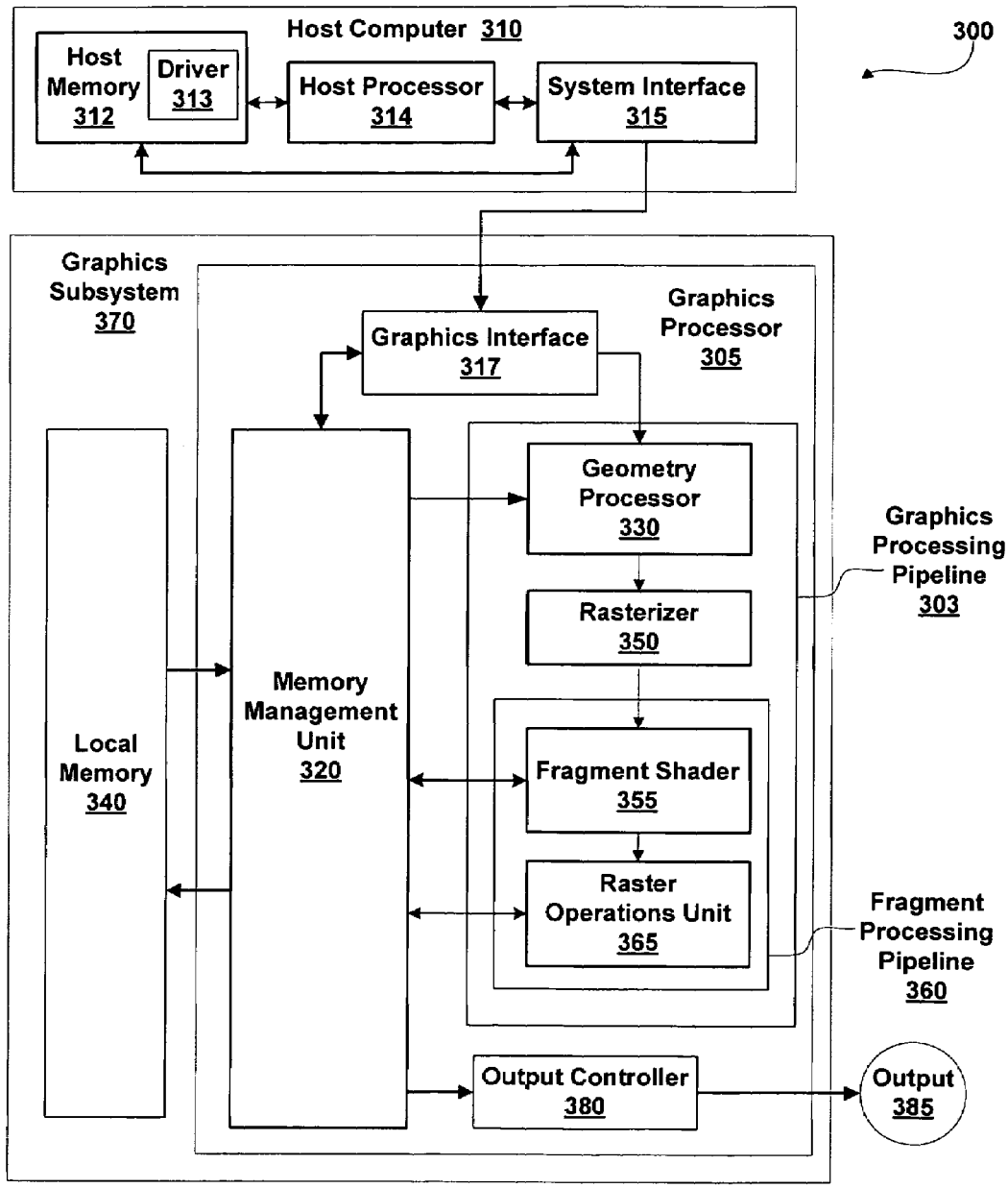
FIG. 3 is a block diagram of a graphics processing system in accordance with one or more aspects of the present invention.

FIG. 3 is a block diagram of an exemplary embodiment of a respective computer system, generally designated 300, and including a host computer 310 and a graphics subsystem 370, in accordance with one or more aspects of the present invention. Computing system 300 may be a desktop computer, server, laptop computer, palm-sized computer, tablet computer, game console, portable wireless terminal such as a PDA or cellular telephone, computer based simulator, or the like. Host computer 310 includes host processor 314 that may include a system memory controller to interface directly to host memory 312 or may communicate with host memory 312 through a system interface 315. System interface 315 may be an I/O (input/output) interface or a bridge device including the system memory controller to interface directly to host memory 312. An example of system interface 315 known in the art includes Intel® Northbridge.

A graphics device driver, driver 313, interfaces between processes executed by host processor 314, such as application programs, and a programmable graphics processor 305, translating program instructions as needed for execution by programmable graphics processor 305. Driver 313 also uses commands to configure sub-units within programmable graphics processor 305. Specifically, driver 313 may specify the colorspace used for texture data, e.g., nonlinear or linear.

Graphics subsystem 370 includes a local memory 340 and programmable graphics processor 305. Host computer 310 communicates with graphics subsystem 370 via system interface 315 and a graphics interface 317 within programmable graphics processor 305. Data, program instructions, and commands received at graphics interface 317 can be passed to a graphics processing pipeline 303 or written to a local memory 340 through memory management unit 320. Programmable graphics processor 305 uses memory to store graphics data, including texture maps, and program instructions, where graphics data is any data that is input to or output from computation units within programmable graphics processor 305. Graphics memory is any memory used to store graphics data or program instructions to be executed by programmable graphics processor 305. Graphics memory can include portions of host memory 312, local memory 340 directly coupled to programmable graphics processor 305, storage resources coupled to the computation units within programmable graphics processor 305, and the like. Storage resources can include register files, caches, FIFOs (first in first out memories), and the like.

In addition to Interface 317, programmable graphics processor 305 includes a graphics processing pipeline 303, a memory management unit 320 and an output controller 380. Data and program instructions received at interface 317 can be passed to a geometry processor 330 within graphics processing pipeline 303 or written to local memory 340 through memory controller 320. In addition to communicating with local memory 340, and interface 317, memory management unit 320 also communicates with graphics processing pipeline 303 and output controller 380 through read and write interfaces in graphics processing pipeline 303 and a read interface in output controller 380.

Within graphics processing pipeline 303, geometry processor 330 and a programmable graphics fragment processing pipeline, fragment processing pipeline 360, perform a variety of computational functions. Some of these functions are table lookup, scalar and vector addition, multiplication, division, coordinate-system mapping, calculation of vector normals, tessellation, calculation of derivatives, interpolation, filtering, and the like. Geometry processor 330 and fragment processing pipeline 360 are optionally configured such that data processing operations are performed in multiple passes through graphics processing pipeline 303 or in multiple passes through fragment processing pipeline 360. Each pass through programmable graphics processor 305, graphics processing pipeline 303 or fragment processing pipeline 360 concludes with optional processing by a raster operations unit 365.

Vertex programs are sequences of vertex program instructions compiled by host processor 314 for execution within geometry processor 330 and rasterizer 350. Shader programs are sequences of shader program instructions compiled by host processor 314 for execution within fragment processing pipeline 360. Geometry processor 330 receives a stream of program instructions (vertex program instructions and shader program instructions) and data from interface 317 or memory management unit 320, and performs vector floating point operations or other processing operations using the data. The program instructions configure subunits within geometry processor 330, rasterizer 350 and fragment processing pipeline 360. The program instructions and data are stored in graphics memory, e.g., portions of host memory 312, local memory 340, or storage resources within programmable graphics processor 305. Alternatively, configuration information is written to registers within geometry processor 330, rasterizer 350 and fragment processing pipeline 360 using program instructions, encoded with the data, or the like.

Data processed by geometry processor 330 and program instructions are passed from geometry processor 330 to a rasterizer 350. Rasterizer 350 is a sampling unit that processes primitives and generates sub-primitive data, such as fragment data, including parameters associated with fragments (texture identifiers, texture coordinates, and the like). Rasterizer 350 converts the primitives into sub-primitive data by performing scan conversion on the data processed by geometry processor 330. Rasterizer 350 outputs fragment data and shader program instructions to fragment processing pipeline 360.

The shader programs configure the fragment processing pipeline 360 to process fragment data by specifying computations and computation precision. Fragment shader 355 is optionally configured by shader program instructions such that fragment data processing operations are performed in multiple passes within fragment shader 355. Fragment shader 355 may perform the functions of previously described fragment shader 255, specifically fragment shader 355 may include one or more colorspace conversion units 200. Texture map data may be applied to the fragment data using techniques known to those skilled in the art to produce shaded fragment data.

Fragment shader 355 outputs the shaded fragment data, e.g., color and depth, and codewords generated from shader program instructions to raster operations unit 365. Raster operations unit 365 includes a read interface and a write interface to memory management unit 320 through which raster operations unit 365 accesses data stored in local memory 340 or host memory 312. Raster operations unit 365 optionally performs near and far plane clipping and raster operations, such as stencil, z test, blending, and the like, using the fragment data and pixel data stored in local memory 340 or host memory 312 at a pixel position (image location specified by x,y coordinates) associated with the processed fragment data. The output data from raster operations unit 365 is written back to local memory 340 or host memory 312 at the pixel position associated with the output data and the results, e.g., image data are saved in graphics memory.

When processing is completed, an output 385 of graphics subsystem 370 is provided using output controller 380. Alternatively, host processor 314 reads the image stored in local memory 340 through memory controller 320, interface 317 and system interface 315. Output controller 380 is optionally configured by opcodes to deliver data to a display device, network, electronic control system, other computing system 300, other graphics subsystem 370, or the like.

Persons skilled in the art will appreciate that any system configured to perform the method steps of FIG. 1A, or its equivalents, is within the scope of the present invention. Nonlinear colorspace data converted into the compact floating point format may be processed using conventional texture filtering computation units designed for processing 8 bit fixed point color components and conventional texture filtering computation units designed for processing exponents of 16 bit floating point color components. Therefore, the performance of processing sRGB colorspace data is equal to the performance of processing 8 bit fixed point format data.

While the foregoing is directed to embodiments of the present invention, other and further embodiments of the invention may be devised without departing from the basic scope thereof, and the scope thereof is determined by the claims that follow. The foregoing description and drawings are, accordingly, to be regarded in an illustrative rather than a restrictive sense. The listing of steps in method claims do not imply performing the steps in any particular order, unless explicitly stated in the claim.

All trademarks are the respective property of their owners.

The invention claimed is:

1. A method of converting nonlinear colorspace data to a linear colorspace represented in a compact floating point format, comprising:

reading the nonlinear colorspace data from memory using texture map coordinates of a fragment;

converting each component of the nonlinear colorspace data to produce linear colorspace components represented in the compact floating point format, wherein the compact floating point format includes both an explicit mantissa without an implied leading one and an exponent, a value represented by the compact floating point format is the explicit mantissa divided by $128*2^{(the\ exponent-7)}$, and the compact floating point format represents the precision required by the nonlinear colorspace data; and processing, by a processor, the linear colorspace components represented in the compact floating point format to produce filtered color components represented in a floating point format of the fragment.

2. The method of claim 1, wherein the converting includes reading a table using a component of the nonlinear colorspace data to obtain the explicit mantissa and the exponent.

3. The method of claim 2, wherein the reading of the table uses a portion of the component of the nonlinear colorspace data to obtain the exponent.

4. The method of claim 1, wherein the nonlinear colorspace is a sRGB colorspace with 8 or 10 bits per component.

5. The method of claim 1, wherein the explicit mantissa is 8 or fewer bits.

6. The method of claim 1, wherein the exponent is 3 bits.

7. The method of claim 1, wherein the processing of a first color component of the color components comprises computing a weighted average of the first color component and other color components to produce a first color component of the filtered color data components represented in the floating point format.

8. The method of claim 1, wherein the color components represented in the compact linear format are processed with a throughput equal to a processing throughput for 8 bit per component color components.

9. A system for converting nonlinear colorspace data to a linear colorspace represented in a compact floating point format, comprising:

an explicit mantissa computation unit configured to convert a nonlinear colorspace component into an 8 bit mantissa of the compact floating point format in the linear colorspace, wherein the 8 bit mantissa does not have an implied leading one;

an exponent computation unit configured to convert the nonlinear colorspace component into a 3 bit exponent of the compact floating point format in the linear colorspace, a value represented by the compact floating point format is the explicit mantissa divided by $128*2^{(the\ exponent-7)}$, and the compact floating point format represents the precision required by the nonlinear colorspace data; and a texture unit configured to compute a filtered texture component by processing converted nonlinear colorspace data represented in the compact floating point format to produce filtered color components represented in a floating point format.

10. The system of claim 9, wherein the nonlinear colorspace is an sRGB colorspace with 8 or 10 bits per component.

11. The system of claim 9, wherein the texture unit includes computation units configured to process 8 bit fixed point components and 8 bit mantissas of the compact floating point format with equal throughput.

12. The system of claim 9, wherein the texture unit includes computation units configured to process 8 bit fixed point components and 3 bit exponents of the compact floating point format with equal throughput.

13. The system of claim 9, wherein the texture unit includes an exponent computation unit configured to process the 3 bit exponent of the compact floating point format.

14. The system of claim 9, wherein the exponent computation unit includes 32 entries that are indexed using a portion of the nonlinear colorspace component.

15. The system of claim 9, wherein the mantissa computation unit includes an entry for each possible value of the nonlinear colorspace component.

* * * * *